US011374327B2

(12) United States Patent
Rogers

(10) Patent No.: US 11,374,327 B2
(45) Date of Patent: Jun. 28, 2022

(54) MICROSTRIP TO MICROSTRIP VIALESS TRANSITION

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/834,457

(22) Filed: Mar. 30, 2020

(65) Prior Publication Data

US 2021/0305704 A1 Sep. 30, 2021

(51) Int. Cl.
*H01Q 9/04* (2006.01)
*H01Q 1/48* (2006.01)

(52) U.S. Cl.
CPC ..... *H01Q 9/0457* (2013.01); *H01Q 1/48* (2013.01)

(58) Field of Classification Search
CPC ..... H01Q 9/04; H01Q 9/0407; H01Q 9/0414; H01Q 9/045; H01Q 9/0457; H01Q 9/0485; H01Q 5/10; H01Q 5/378; H01Q 5/385; H01Q 1/422; H01Q 21/0075
See application file for complete search history.

(56) References Cited

U.S. PATENT DOCUMENTS 4,710,775 A * 12/1987 Coe ..... H01Q 13/18 343/793
4,843,400 A * 6/1989 Tsao ..... H01Q 21/065 343/700 MS
4,847,625 A * 7/1989 Dietrich ..... H01Q 9/0457 343/700 MS
5,497,164 A * 3/1996 Croq ..... H01Q 19/005 343/846
6,114,998 A * 9/2000 Schefte ..... H01Q 9/0414 343/768
6,346,913 B1 * 2/2002 Chang ..... H01Q 9/0407 343/702
6,940,457 B2 * 9/2005 Lee ..... H01Q 9/0407 343/840
6,946,995 B2 * 9/2005 Choi ..... H01Q 19/062 343/895

(Continued)

OTHER PUBLICATIONS

Kim, J, et al. "Novel Microstrip-To-Stripline Transitions for Leakage Suppression in Multilayer Microwave Circuits", IEEE Topical Meeting on Electrical Performance of Electronic Packaging, Oct. 1, 1998, pp. 252-255.
Zhu, L., et al., "Ultrabroad-Band Vertical Transition for Multilayer Integrated Circuits", IEEE Microwave and Guided Wave Letters, Nov. 1, 1999, pp. 453-455, vo. 9, No. 11.
Houdart, M., et al., "Various Excitation of Coplanar Waveguide", IEEE MTT-S, Apr. 1, 1979, pp. 116-118.

(Continued)

*Primary Examiner* — Jason Crawford
(74) *Attorney, Agent, or Firm* — Coats & Bennett, PLLC

(57) ABSTRACT

An apparatus for vialess transitions can include a first dielectric layer. The apparatus can also include a first conductor forming a first coupling element on the top surface of the first dielectric layer. The apparatus can further include a second dielectric layer positioned below the first dielectric layer and above a third dielectric layer, wherein the second dielectric layer is vialess. The apparatus can include a second conductor forming a second coupling element, wherein the second conductor is on the top surface of the third dielectric layer, and a portion of the first coupling element is directly above a portion of the second coupling element.

20 Claims, 10 Drawing Sheets

(56) References Cited

U.S. PATENT DOCUMENTS

| | | | | |
|---|---|---|---|---|
| 8,519,891 | B2 * | 8/2013 | Chen | H01Q 21/0075 343/852 |
| 9,853,359 | B2 * | 12/2017 | Elsherbini | H01Q 21/067 |
| 2005/0054317 | A1 * | 3/2005 | Ro | H01Q 5/42 455/575.1 |
| 2005/0275590 | A1 * | 12/2005 | Eom | H01Q 1/22 343/700 MS |
| 2016/0197404 | A1 * | 7/2016 | Hashimoto | H01Q 1/48 343/848 |
| 2017/0373365 | A1 * | 12/2017 | U-Yen | H01P 3/003 |
| 2018/0233796 | A1 * | 8/2018 | Zhang | H01P 5/185 |
| 2019/0296449 | A1 * | 9/2019 | Hashimoto | H01Q 9/0457 |
| 2020/0058999 | A1 * | 2/2020 | Lamminen | H01Q 1/48 |
| 2021/0305704 | A1 * | 9/2021 | Rogers | H01Q 1/48 |

OTHER PUBLICATIONS

Ellis, T., et al., "A Wideband CPW-to-Microstrip Transition for Millimeter-Wave Packaging", IEEE MTT-S, Jun. 1, 1999, pp. 629-632.

Raskin, J., et al., "Mode Conversion at GCPW-to-Microstrip-Line Transitions", IEEE Transactions on Microwave Theory and Techniques, Jan. 1, 2000, pp. 158-161, vol. 48, No. 1.

Chung, D., et al., "Low Loss Multilayer Transitions using via Technology on LCP from DC to 40 GHz", Electronic Components and Technology Conference, 2009, pp. 2025-2029.

Tsai, C., et al., "Design of Microstrip-to-Microstrip via Transition in Multilayered LTCC for Frequencies up to 67 Ghz", IEEE Transactions on Components, Packaging, and Manufacturing Technology, Apr. 1, 2011, pp. 595-601, vol. 1, No. 4.

Huang, X, et al., "A Broadband and Vialess Vertical Microstrip-to-Microstrip Transition", IEEE Transactions on Microwave Theory and Techniques, Apr. 1, 2012, pp. 938-944, vol. 60, No. 4.

* cited by examiner

MICROSTRIP TO MICROSTRIP VIALESS TRANSITION

TECHNOLOGICAL FIELD

The present disclosure relates generally to the field of signal transmission. More specifically the present disclosure relates to the field of microstrip to microstrip vialess transition.

BACKGROUND

Today, radio frequency (RF) electronics are commonly integrated on printed circuit boards (PCB). There are applications where it is desirable to transition through two or more layers in a multilayer PCB to interconnect to such RF electronics. Planar traces, such as microstrip, are used for connecting to packaged RF electronics chips. Existing transitions are generally single layer or multilayer transitions. Combinations of microstrip to coplanar waveguide, grounded coplanar waveguide, and stripline have been made. Often, an electrical via is used to transition one layer to another in order to transition from a trace on one board to a trace on a different board. This can cause issues in impedance matching in the transition from one layer to the other. Some existing transitions include single layer or multilayer transitions. Combinations of microstrip to coplanar waveguide, grounded coplanar waveguide, and stripline have been made.

Microstrip is a conductor line on a substrate with a reference ground plane underneath the conductor such that at low frequencies, the conductor behaves like a short circuit from one point to another. Looking at higher frequencies, the conductor exhibits both inductive and capacitive behavior in what is considered a transmission line. There is intrinsic inductance and capacitance associated with the dielectric such that the width of a trace can be designed to behave a certain way. The designed width of the conductor determines the characteristic impedance of the line. The characteristic impedance of the line is determined such as to maximize power transfer from one point to another.

SUMMARY

The following presents a simplified summary of the disclosure in order to provide a basic understanding to those of skill in the art. This summary is not an extensive overview of the disclosure and is not intended to identify key/critical elements of aspects of the invention or to delineate the scope of the invention. The sole purpose of this summary is to present some concepts disclosed herein in a simplified form as a prelude to the more detailed description that is presented later.

According to one or more aspects described and claimed herein, an apparatus can include a first dielectric layer. The apparatus further includes a first conductor on the top surface of the first dielectric layer, the first dielectric layer forming a first coupling element. The apparatus further includes a second dielectric layer positioned below the first dielectric layer and above a third dielectric layer, wherein the second dielectric layer is vialess. The apparatus further includes a second conductor forming a second coupling element, wherein the second conductor is on the top surface of the third dielectric layer, and a portion of the first coupling element is directly above a portion of the second coupling element.

According to further aspects, the first coupling element is greater in width than the second coupling element.

According to further aspects, the first conductor further forms a patch antenna.

According to further aspects, the first coupling element and the second coupling element transmit and/or receive at a radio frequency (RF).

According to further aspects, the apparatus further includes a fourth dielectric layer positioned below the second dielectric layer and below the third dielectric layer. The apparatus further includes a third conductor forming a ground plane, wherein the third conductor is on the bottom surface of the fourth dielectric layer, a portion of the first coupling element is directly above a portion of the ground plane, and a portion of the second coupling element is directly above a portion of the ground plane.

According to further aspects, the first and second coupling elements are parallel across the plane of the apparatus.

According to further aspects, the first and second coupling elements are orthogonal across the plane of the apparatus.

According to further aspects, the apparatus includes at least one of the following: an amplifier, a filter, a mixer, and/or an attenuator.

In another aspect, the present application discloses a method of forming a vialess transition, the method including depositing a first dielectric layer. The method further includes depositing a first conductor on the top surface of the first dielectric layer, the first dielectric layer forming a first coupling element. The method further includes depositing a second dielectric layer positioned below the first dielectric layer and above a third dielectric layer, wherein the second dielectric layer is vialess. The method further includes depositing a second conductor forming a second coupling element, wherein the second conductor is on the top surface of the third dielectric layer, and a portion of the first coupling element is directly above a portion of the second coupling element.

According to further aspects, the first coupling element is greater in width than the second coupling element.

According to further aspects, the first conductor further forms a patch antenna.

According to further aspects, the first coupling element is a radio frequency (RF) coupling element.

According to further aspects, the method further includes depositing a fourth dielectric layer positioned below the third dielectric layer.

According to further aspects, the method further includes depositing a third conductor forming a ground plane, wherein the third conductor is on the bottom surface of the fourth dielectric layer, a portion of the first coupling element is directly above a portion of the ground plane, and a portion of the second coupling element is directly above a portion of the ground plane.

According to further aspects, the first and second coupling elements are parallel across the plane of the vialess transition.

According to further aspects, the first and second coupling elements are orthogonal across the plane of the vialess transition.

According to further aspects, at least one of the first coupling element and/or the second coupling element is a microstrip feed line.

In another aspect, the present application discloses a computer-readable storage medium, the computer-readable storage medium being non-transitory and having computer-readable program code portions stored therein that in response to execution by a processor, cause an apparatus to at least deposit a first dielectric layer. The apparatus is further caused to deposit a first conductor forming a first coupling element on the top surface of the first dielectric layer.

The apparatus is further caused to deposit a second dielectric layer positioned below the first dielectric layer and above a third dielectric layer, wherein the second dielectric layer is vialess. The apparatus is further caused to deposit a second conductor forming a second coupling element, wherein the second conductor is on the top surface of the third dielectric layer, and a portion of the first coupling element is directly above a portion of the second coupling element.

According to further aspects, the apparatus is caused to deposit a fourth dielectric layer positioned below the third dielectric layer. The apparatus is further caused to deposit a third conductor forming a ground plane, wherein the third conductor is on the bottom surface of the fourth dielectric layer, a portion of the first coupling element is directly above a portion of the ground plane, and a portion of the second coupling element is directly above a portion of the ground plane.

The features, functions and advantages that have been discussed can be achieved independently in various aspects or may be combined in yet other aspects, further details of which can be seen with reference to the following description and the drawings.

BRIEF DESCRIPTION OF THE DRAWINGS

Figure 1:
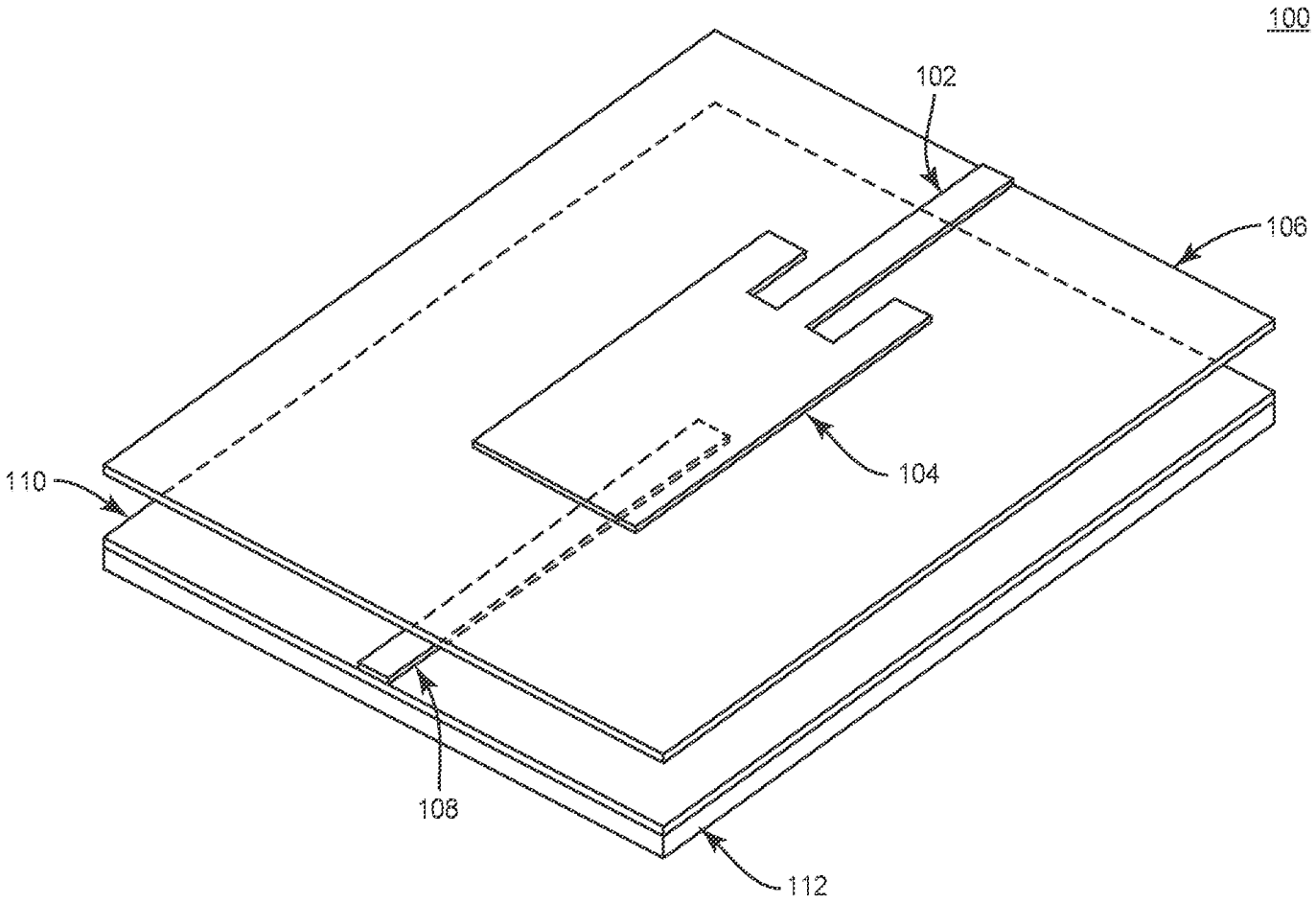

Having thus described variations of the disclosure in general terms, reference will now be made to the accompanying drawings, which are not necessarily drawn to scale, and wherein:

FIG. 1 is an exemplary microstrip to microstrip vialess transition.

Figure 2:
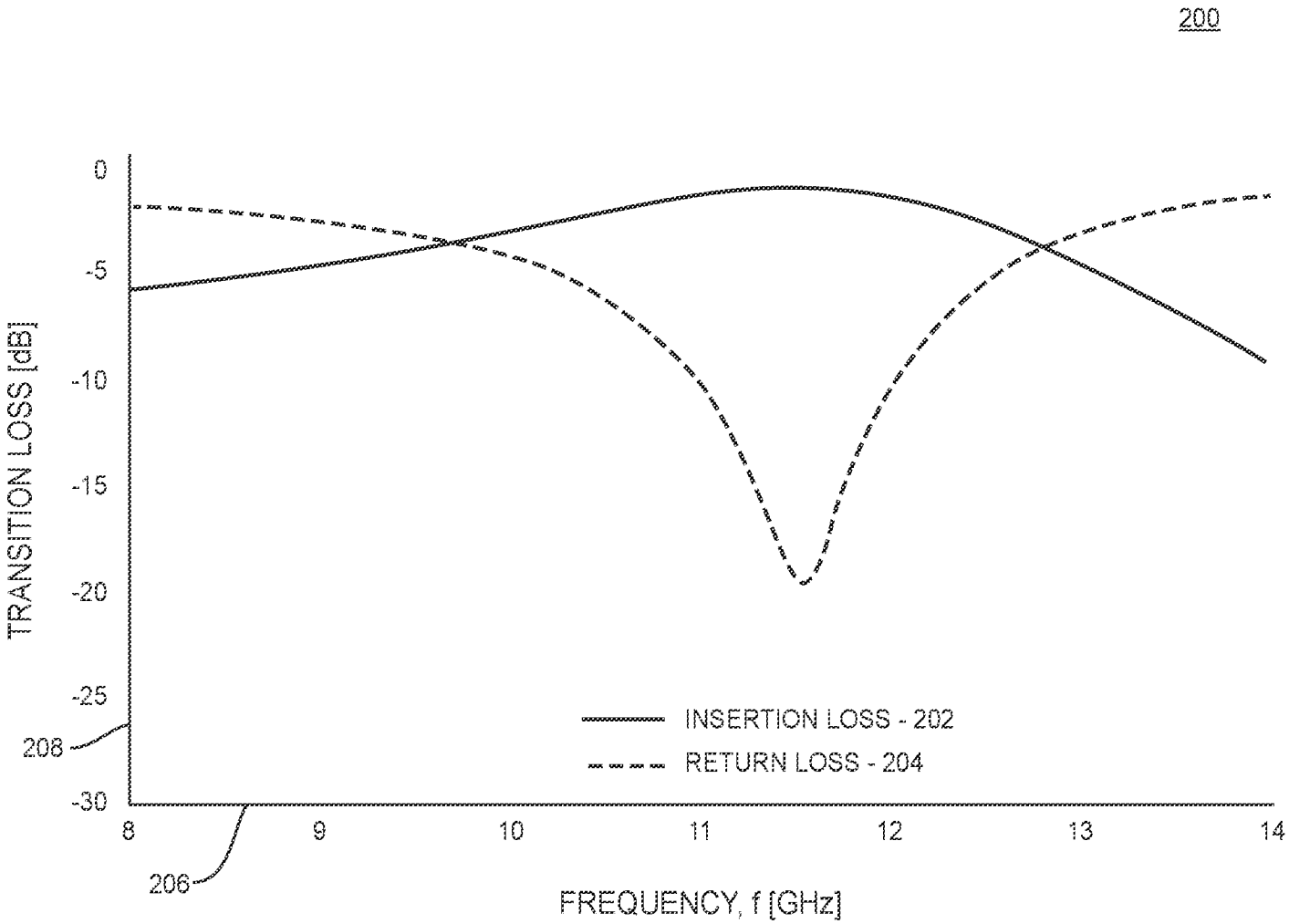

FIG. 2 is an illustrative graph of a multilayer microstrip to microstrip vialess transition.

Figure 3:
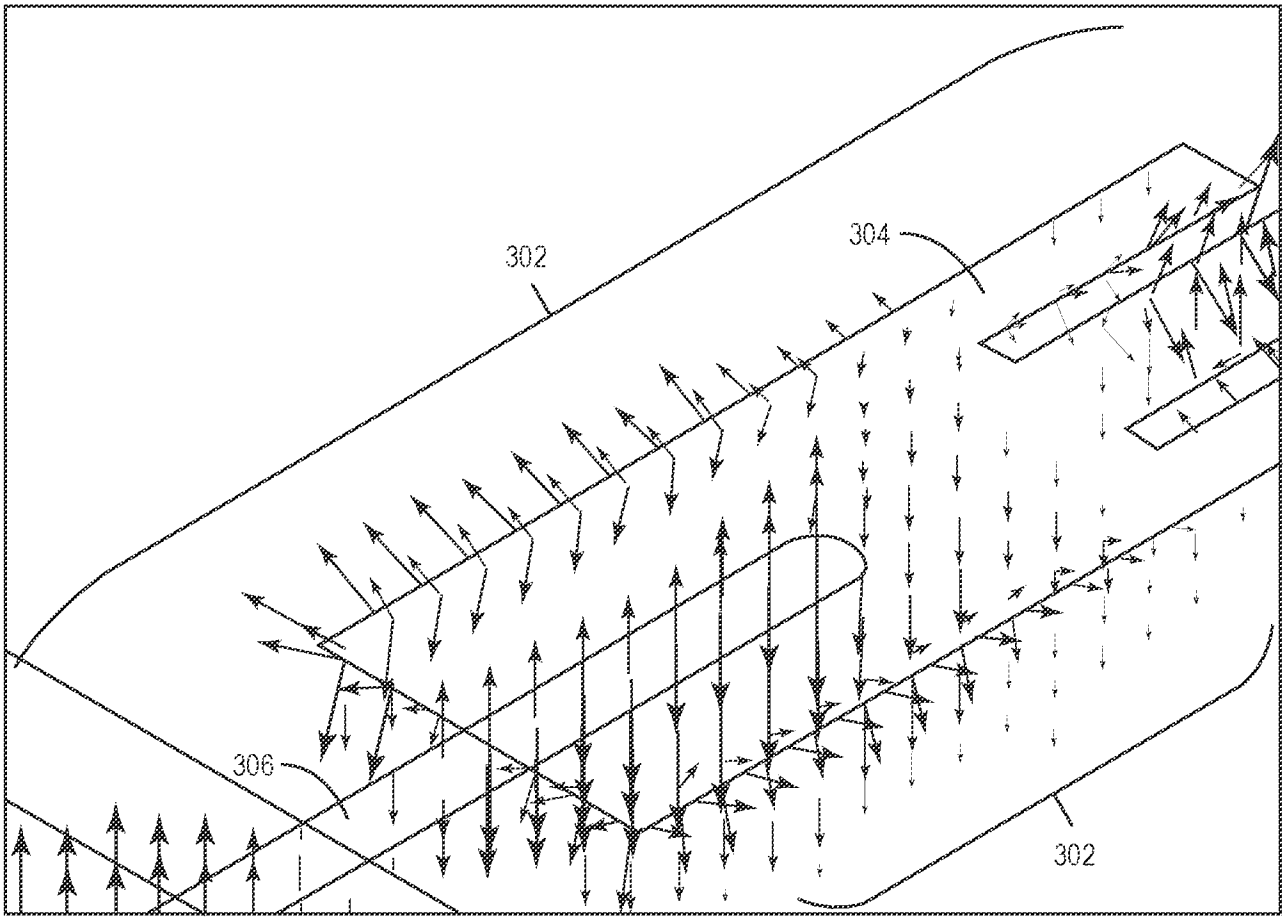

FIG. 3 shows an exemplary electric field plot.

Figure 4:
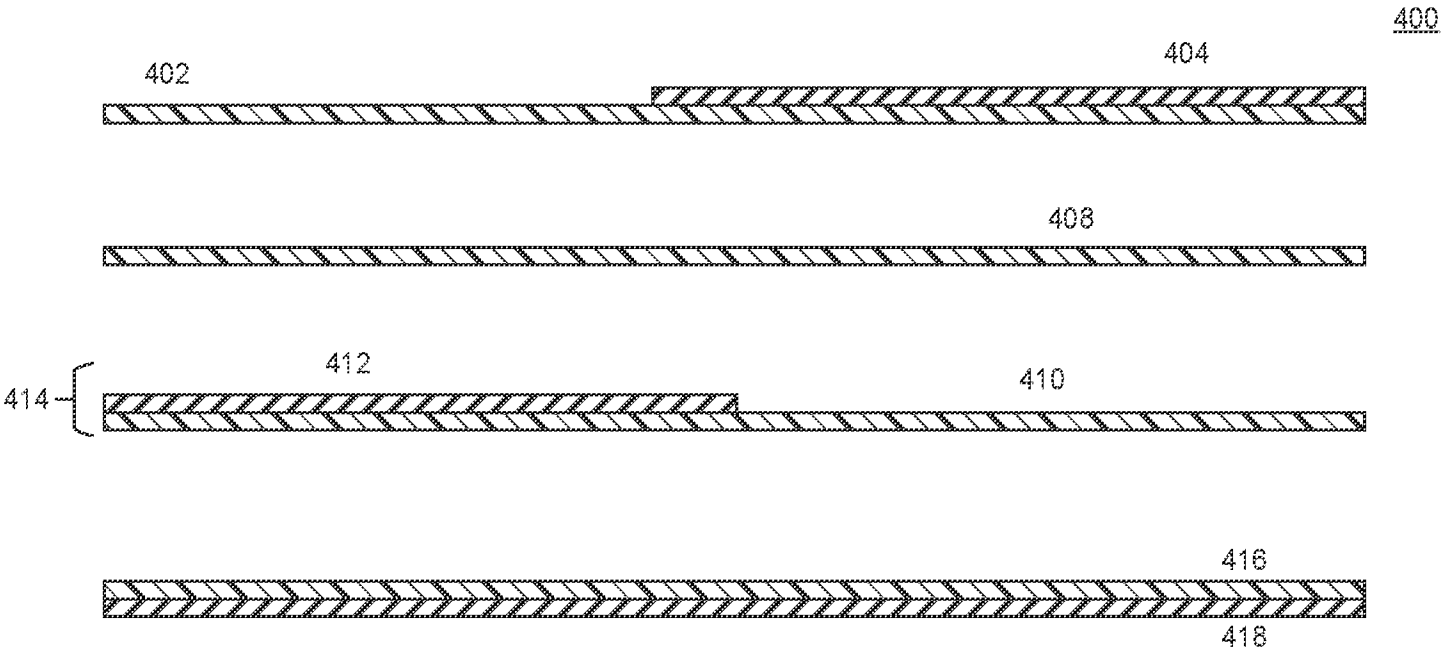

FIG. 4 illustrates a cross-section view of fabrication of an embodiment to form a vialess transition.

Figure 5:
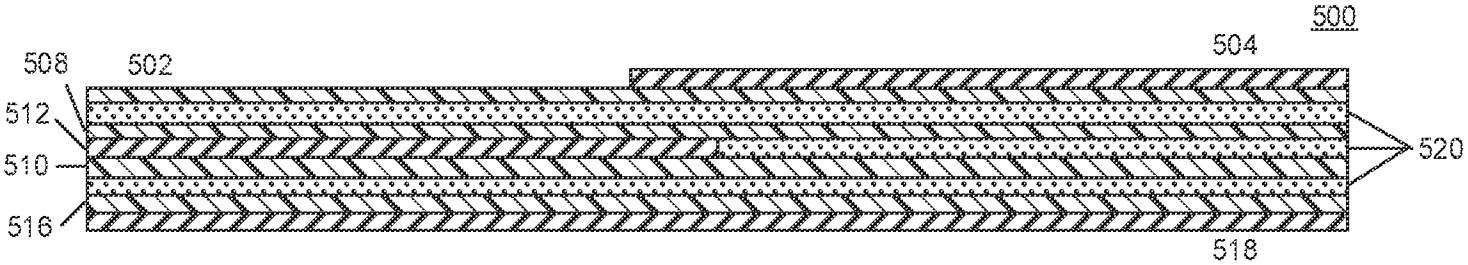

FIG. 5 is an exemplary microstrip to microstrip vialess transition.

Figure 6:
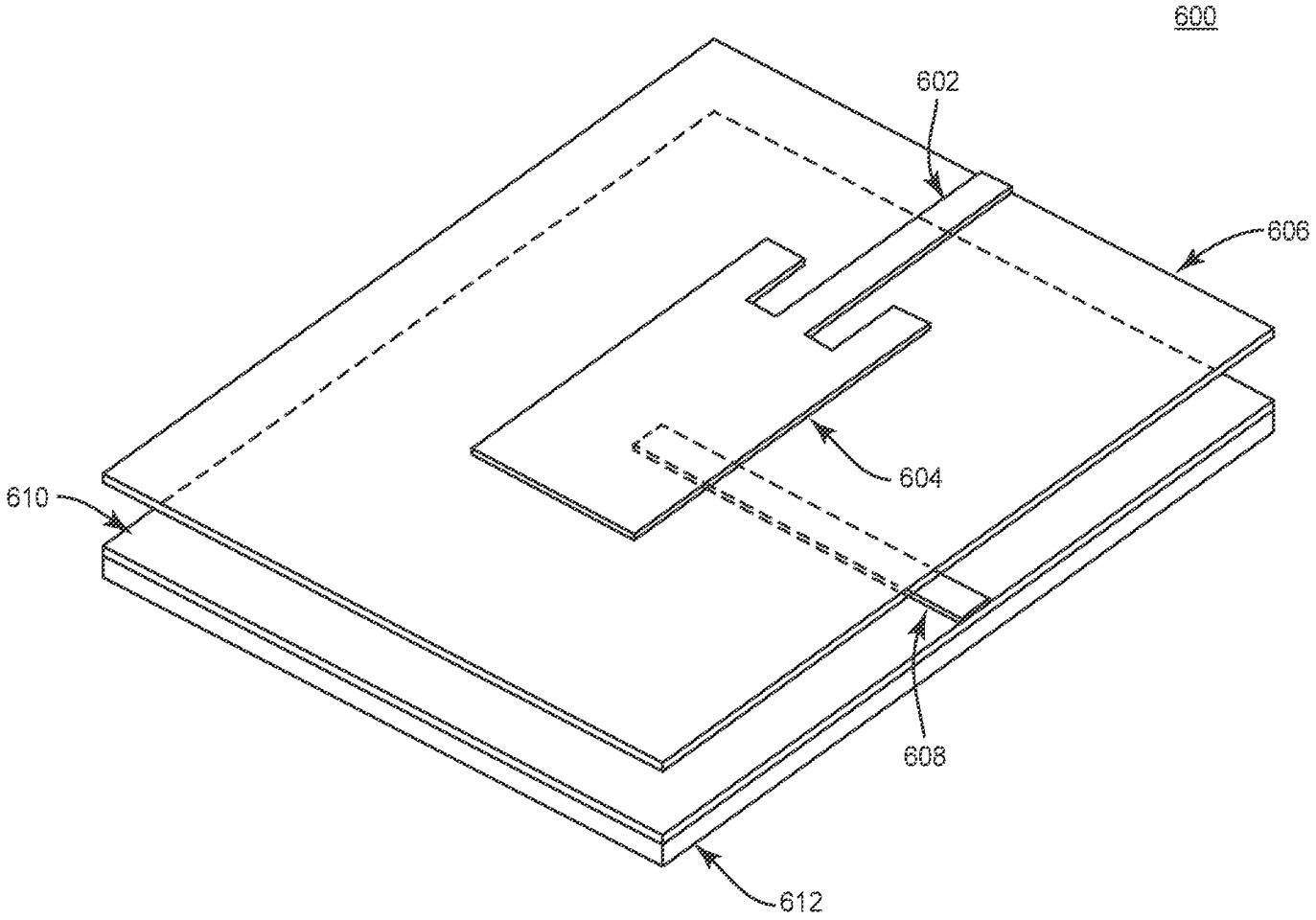

FIG. 6 is an exemplary microstrip to microstrip vialess transition.

Figure 7:
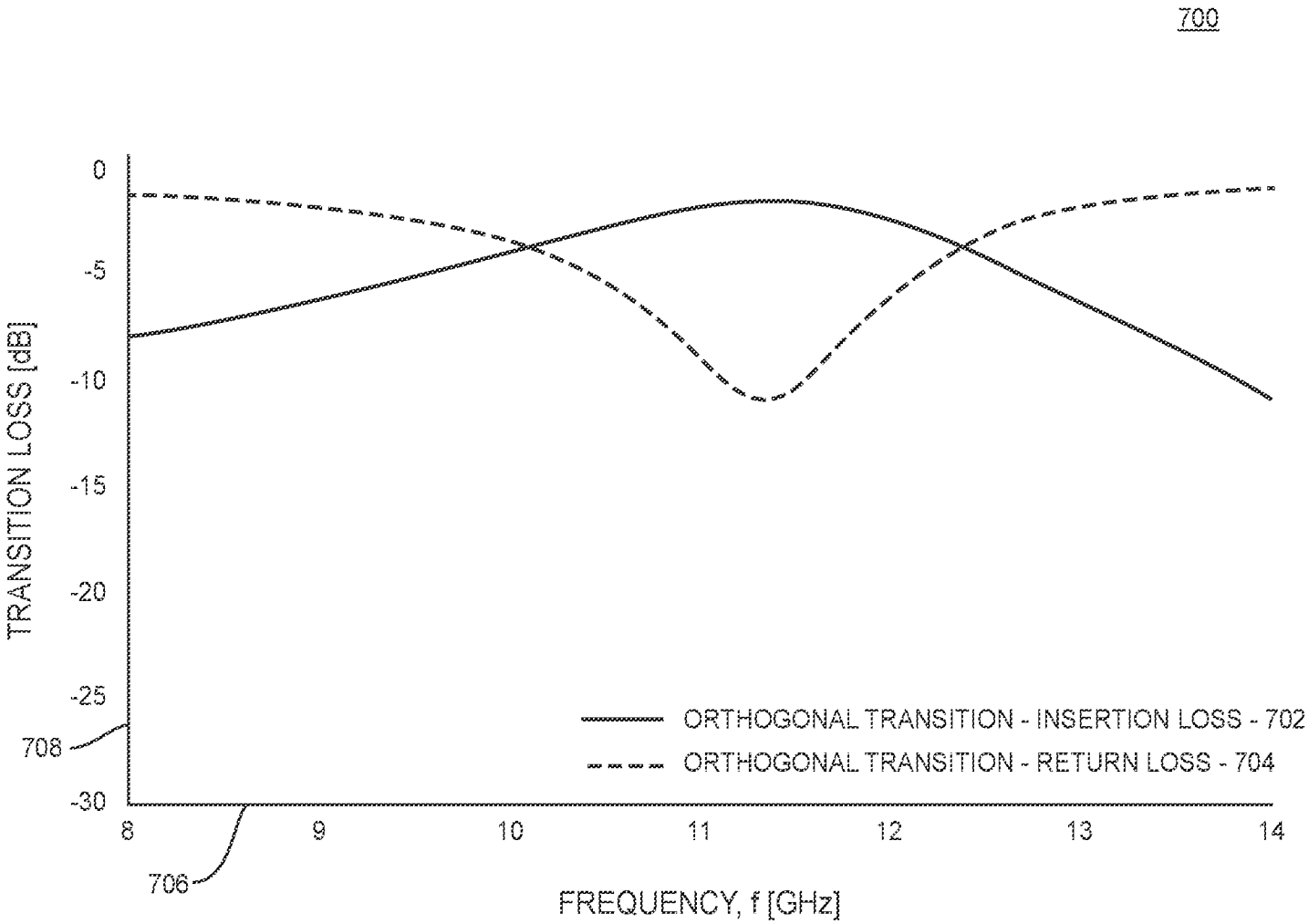

FIG. 7 is an illustrative graph of a multilayer microstrip to microstrip vialess transition.

Figure 8:
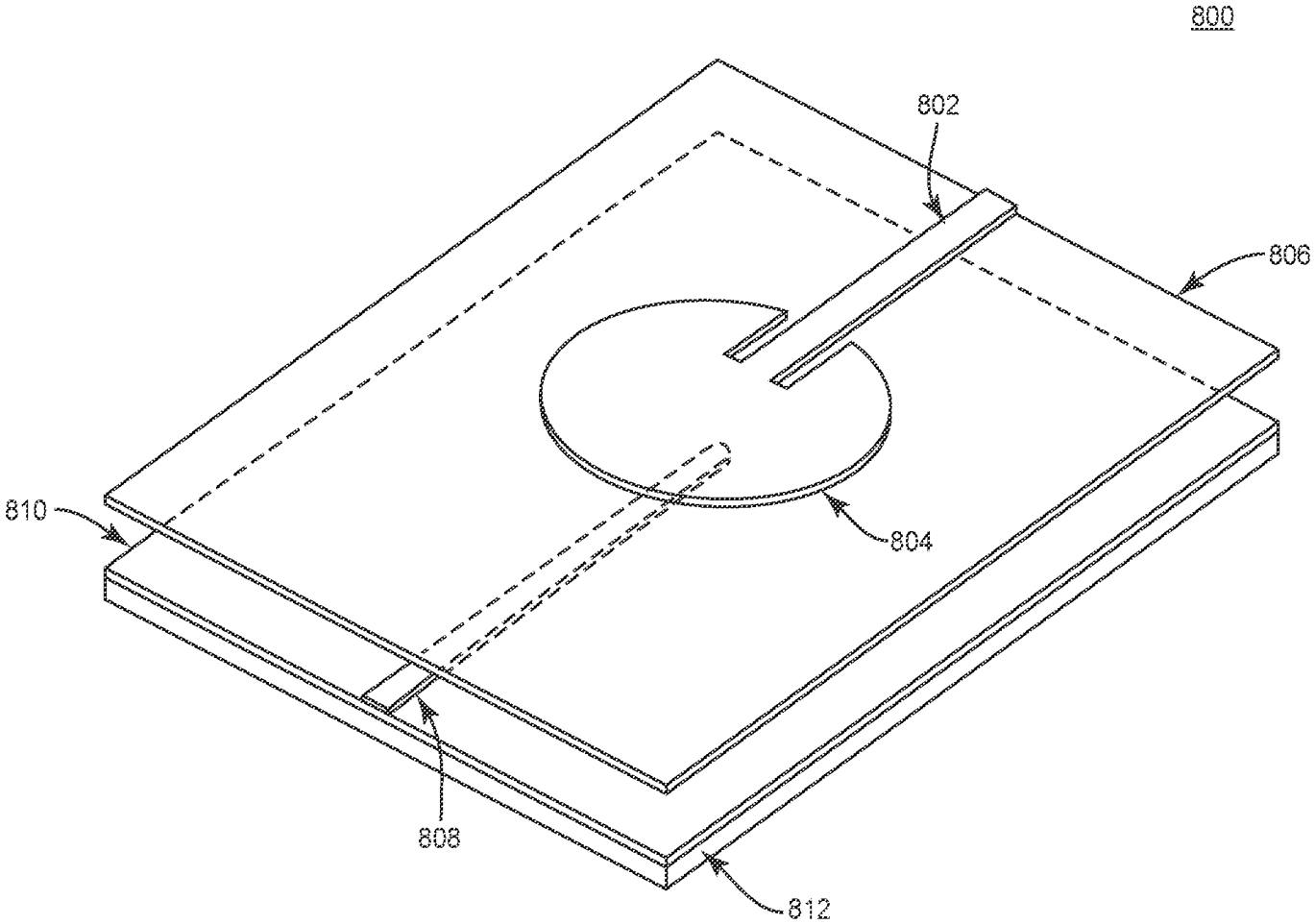

FIG. 8 is an exemplary microstrip to microstrip vialess transition.

Figure 9:
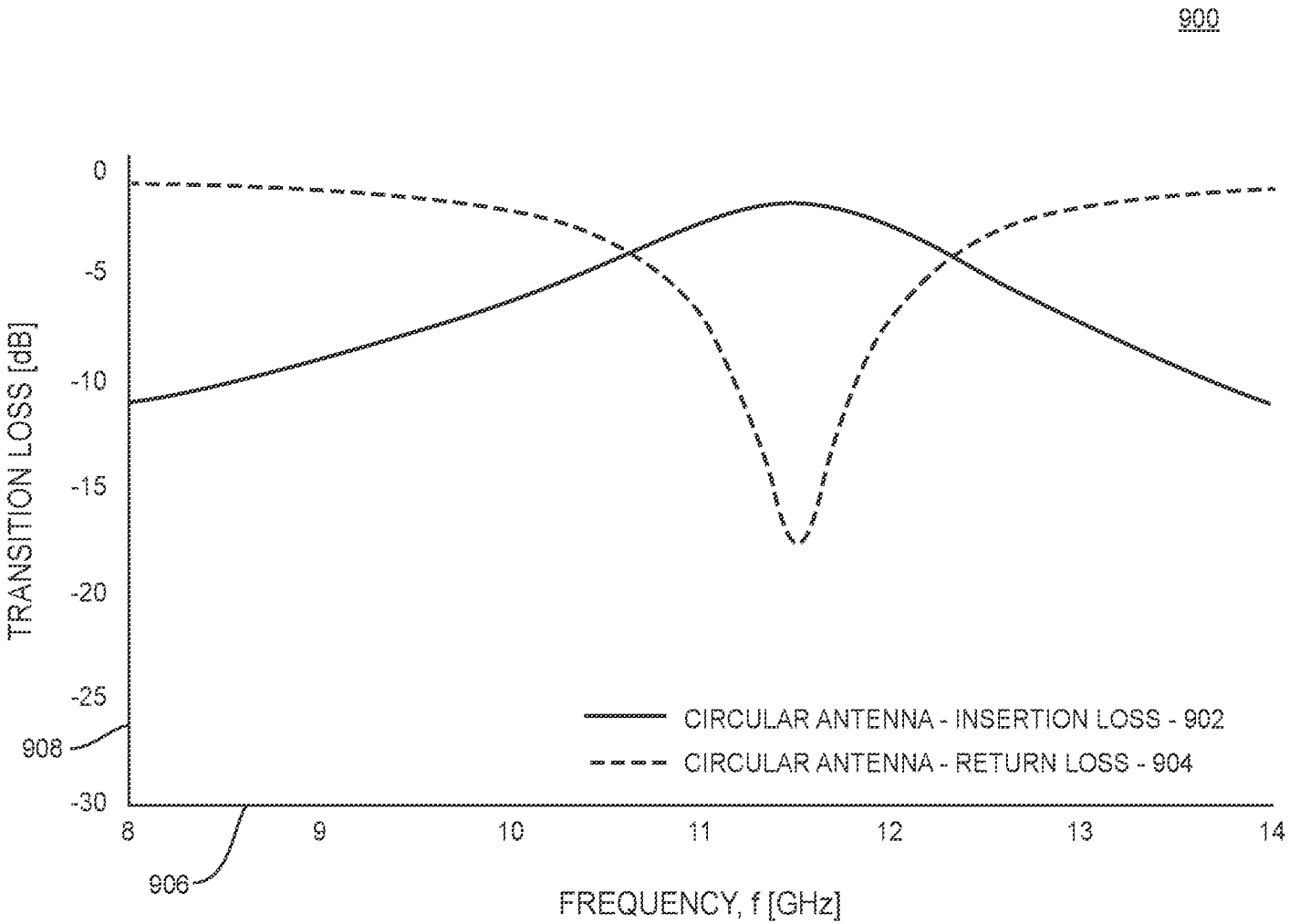

FIG. 9 is an illustrative graph of a multilayer microstrip to microstrip vialess transition.

Figure 10:
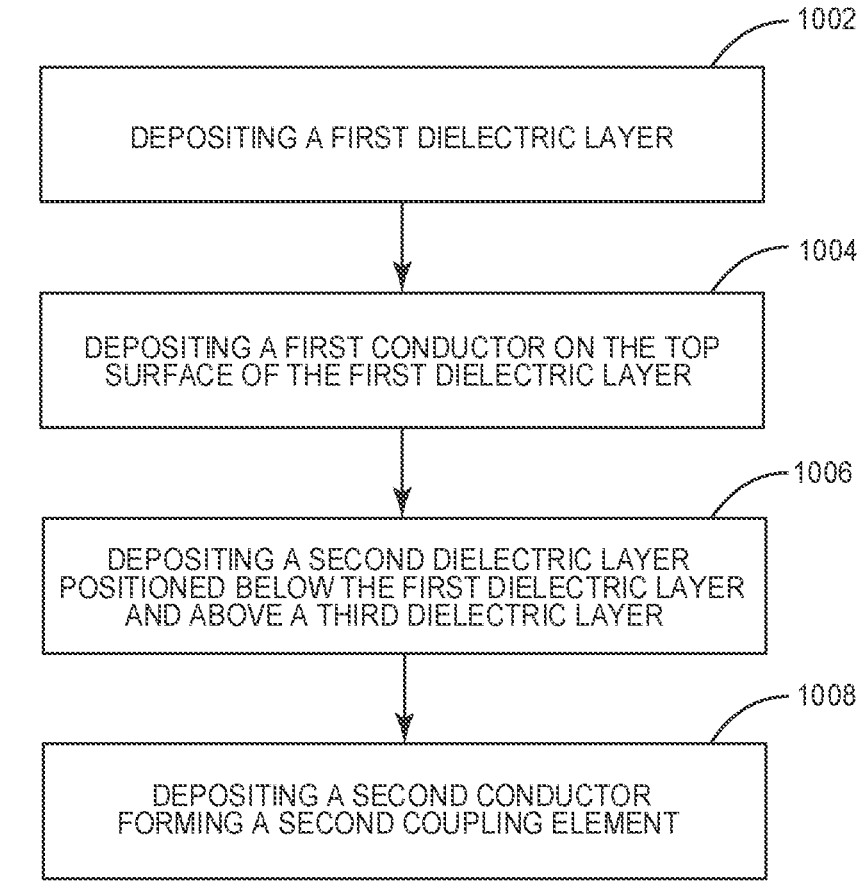

FIG. 10 is a flowchart that illustrates forming a vialess transition according to one embodiment.

Figure 11:
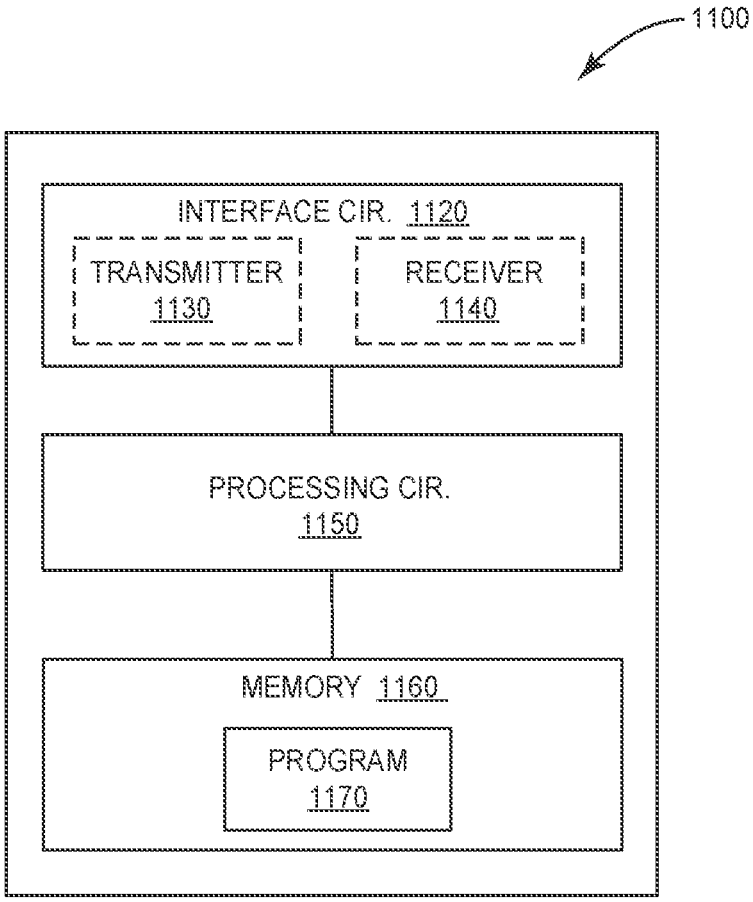

FIG. 11 illustrates an example apparatus according to some example implementations of the present disclosure.

DETAILED DESCRIPTION

In this disclosure, a multilayer microstrip to microstrip vialess transition is described consisting of: a microstrip feed line with an edge fed patch antenna on the surface of a composite RF board, a microstrip feed line embedded in the RF board and proximity coupled to the patch antenna, and a ground plane below the two microstrip feed lines. There are no electrical vias (i.e., electrical shorts) connecting the two microstrip feed lines.

The microstrip to microstrip vialess transition differs from other existing solutions in that it has a surface RF microstrip feed line electrically coupled to a ground plane; has an embedded RF microstrip feed line electrically coupled to the ground plane; has a patch antenna on the top surface of a composite RF board that is edge fed by the surface microstrip feed line and proximity coupled to the embedded microstrip feed line; has no electrical vias connecting the surface microstrip feed line to the embedded microstrip feed line; is surface agnostic; and can be manufactured using a combination of subtractive (e.g., laser etch, milling, wet etching) and additive (e.g., printing, film deposition) methods.

The ability to provide a microstrip to microstrip transition can allow electronics to reside on a single board for efficient signal propagation and processing in some integrated electronics. Furthermore, the use of integrated electronics can result in reduced size, weight, and power (SWaP).

FIG. 1 is an example of a microstrip to microstrip vialess transition 100. A microstrip feed line 102 with an edge fed patch antenna 104 on a first dielectric layer 106, an embedded microstrip feed line 108 in a composite RF board 110, and a ground plane 112 below the two microstrip feed lines 102, 108. The two microstrip feed lines 102, 108 can be electrically coupled around a desired operating frequency. The dimensions of microstrip feed lines (e.g., width) and the patch antenna (e.g., patch width, patch length, inset length, inset spacing) can be numerically determined to maximize signal transmission.

In some embodiments, the embedded microstrip 108 can have a smaller width than the microstrip 102 on the top layer. Each dielectric layer further from the ground plane 112 can have a wider trace than the dielectric layer below it. In some embodiments, this can allow for impedance matching.

FIG. 2 is an illustrative graph 200 of a multilayer microstrip to microstrip vialess transition performance. The transition can operate, for example, at approximately 11.5 GHz. There is an insertion loss 202 of approximately 0.75 dB at 11.6 GHz and a 2:1 voltage standing wave ratio (VSWR) impedance bandwidth of 1.1 GHz.

More specifically, in FIG. 2, the insertion loss 202 is how much power is transferred from the embedded microstrip to the microstrip on the surface, or vice versa. The transition can be a reciprocal device, such as a passive reciprocal device. As shown, maximum power transfer is achieved around 11.5 GHz. Minimal reflection, or return loss 204, occurs at that same frequency at approximately −20 dB. In FIG. 2, every reduction by 10 dB, there can be a tenth of a reflection in power. For example, −10 dB can equate to 10% reflection, −20 dB can equate to 1% reflection in power. The frequency (in GHz) is shown in the graph 200 in the x-axis 206 and the transition loss is shown in the y axis 708.

In some embodiments, to operate at lower frequencies, a patch antenna can be designed larger to resonate at desired frequencies. To operate at a higher frequency, the patch antenna can be designed smaller to resonate at a higher frequency. Similarly, if the patch antenna is closer to the embedded microstrip, the coupling can be increased.

FIG. 3 shows an exemplary electric field plot 300 with the electric field in V/m in vector form 302 along the patch antenna 304 and embedded feed line 306 at approximately 10 GHz. The intensity of the electric field vectors indicates a strong coupling between the embedded feed line 306, the patch antenna 304, and the ground plane (not shown) below the feed lines. As shown, a maximum and minimum voltage (illustrated respectively by larger and smaller width arrows) go back and forth in a sinusoidal fashion, where the strongest power transfer is between the feed line and the patch element at an angled connection from the horizontal plane to the vertical plane.

FIG. 4 illustrates a cross-section view of fabrication of an embodiment to form a vialess transition 400. In FIG. 4, four dielectric layers are shown in cross-section, where a subtractive patterning is used to remove the conductive material (e.g., copper) from the dielectric substrates with the conductive material cladded both on the top and bottom sides. As shown in FIG. 4, the first dielectric layer 402 has the copper on the bottom side and some of the copper on the top side removed. The portion of the copper shown on the first dielectric layer 402 is a first conductor 404.

An optional vialess second dielectric layer 408 is shown below the first dielectric layer 402. As shown, the second dielectric layer 408 has no copper on the top or bottom. The second dielectric layer 408 can be useful in order to increase the distance between a third dielectric layer 410 and the first dielectric layer 402.

The third dielectric layer 410 is shown with a second conductor 412, both forming a second coupling element 414. At the bottom of the transition 400, a fourth dielectric layer 416 has the top copper layer removed, leaving the bottom conductive material forming a ground plane 418.

In some embodiments, additive and/or subtractive techniques can be used. Each dielectric layer of the transition can be processed using a combination of subtractive (e.g., laser etch, milling, wet etching) and additive (e.g., printing, deposition) methods. The four layers can then be bonded (e.g., by lamination) to produce the final assembly.

In some embodiments, the process can deposit or print a conductive material onto a flexible material. This can allow for more flexible materials having connections without weakening the substrate with vias to form the transitions.

FIG. 5 is an exemplary cross-section of a laminated microstrip to microstrip vialess transition 500. Similar to the layers shown in FIG. 4, the vialess transition 500 has a first dielectric layer 502 with a first conductor 504, a second dielectric layer 508 with no vias or conductive material, a third dielectric layer 510 shown with a second conductor 512, and a fourth dielectric layer 516 with a bottom conductive material forming a ground plane 518. In between the dielectric layers is a laminate material 520 to create the laminated microstrip to microstrip vialess transition 500.

FIG. 6 is an example of a microstrip to microstrip vialess transition 600. A microstrip feed line 602 with an edge fed patch antenna 604 on a first dielectric layer 606, an embedded microstrip feed line 608 in a composite RF board 610, and a ground plane 612 below the two microstrip feed lines 602, 608. The two microstrip feed lines 602, 608 can be electrically coupled around a desired operating frequency. As shown, the patch antenna 604 and the feed line 602 are orthogonal to each other.

FIG. 7 is an illustrative graph 700 of a multilayer microstrip to microstrip vialess transition performance similar to the vialess transition of FIG. 6. The transition can operate, for example, at approximately 11.3 GHz. There is an insertion loss 702 of approximately −2 dB at 11.3 GHz. Minimal reflection, or return loss 704, occurs at approximately −10.5 dB. The frequency (in GHz) is shown in the graph 700 in the x-axis 706 and the transition loss is shown in the y axis 708.

FIG. 8 is an example of a microstrip to microstrip vialess transition 800. A microstrip feed line 802 with an edge fed patch antenna 804 on a first dielectric layer 806, an embedded microstrip feed line 808 in a composite RF board 810, and a ground plane 812 below the two microstrip feed lines 802, 808. The two microstrip feed lines 802, 808 can be electrically coupled around a desired operating frequency. As shown, the patch antenna 804 is circular in shape.

FIG. 9 is an illustrative graph 900 of a multilayer microstrip to microstrip vialess transition performance similar to the vialess transition of FIG. 8. The transition can operate, for example, at approximately 11.5 GHz. There is an insertion loss 902 of approximately 2 dB at 11.5 GHz. Minimal reflection, or return loss 904, occurs at approximately −16 dB. The frequency (in GHz) is shown in the graph 900 in the x-axis 906 and the transition loss is shown in the y axis 908.

FIG. 10 is a flowchart that illustrates forming a vialess transition according to one embodiment. In FIG. 10, a method 1000 comprises at 1002, depositing a first dielectric layer. According to one embodiment, the vialess transition can be part of a low power steerable array (LPSA). For an LPSA, the vialess transition would allow RF electronics to reside on a single RF board for efficient signal propagation and processing.

The method further includes at 1004, depositing a first conductor on the top surface of the first dielectric layer, the first dielectric layer forming a first coupling element. According to one embodiment, the first conductor can form a patch antenna. In some embodiments, the coupling element can be an RF coupling element. In some embodiments, the vialess transition can further include an amplifier, a filter, a mixer, and/or an attenuator.

The method also includes at 1006, depositing a second dielectric layer positioned below the first dielectric layer and above a third dielectric layer, wherein the second dielectric layer is vialess.

The method further includes at 1008 depositing a second conductor forming a second coupling element, wherein the second conductor is on the top surface of the third dielectric layer, and a portion of the first coupling element is directly above a portion of the second coupling element. According to one embodiment, the first coupling element can be greater in width than the second coupling element. In some embodiments, the first and second coupling elements can be parallel across the plane of the apparatus. In some embodiments, the first and second coupling elements can be orthogonal across the plane of the apparatus.

In some embodiments, the method 1000 can include depositing a fourth dielectric layer positioned below the third dielectric layer. The method 1000 can further include depositing a third conductor forming a ground plane, wherein the third conductor can be on the bottom surface of the fourth dielectric layer, and a portion of the first coupling element can be directly above a portion of the ground plane, and a portion of the second coupling element can be directly above a portion of the ground plane.

The method illustrated generally in FIG. 10 is non-limiting and can be implemented by at least a portion of the apparatuses and systems presented in at least one of FIGS. 4 and 11.

FIG. 11 illustrates an apparatus 1100 according to some example implementations of the present disclosure. The apparatuses and systems presented in at least one of FIGS. 2-5 can comprise at least a portion of apparatus 1100. Further, method 1000 can be performed by at least a portion of apparatus 1100. Generally, an apparatus of exemplary implementations of the present disclosure may comprise, include or be embodied in one or more fixed or portable electronic devices. Examples of suitable electronic devices include a smartphone, tablet computer, laptop computer, desktop computer, workstation computer, server computer or the like. The apparatus may include one or more of each of a number of components such as, for example, processing circuitry 1150 (e.g., processor unit) connected to a memory 1160 (e.g., storage device).

The processing circuitry 1150 may be composed of one or more processors alone or in combination with one or more memories. The processing circuitry is generally any piece of computer hardware that is capable of processing information such as, for example, data, computer programs and/or other suitable electronic information. The processing circuitry is composed of a collection of electronic circuits some of which may be packaged as an integrated circuit or multiple interconnected integrated circuits (an integrated circuit at times more commonly referred to as a "chip"). The processing circuitry may be configured to execute computer programs, which may be stored onboard the processing circuitry or otherwise stored in the memory 1160 (of the same or another apparatus).

The processing circuitry 1150 may be a number of processors, a multi-core processor or some other type of processor, depending on the particular implementation. Further, the processing circuitry may be implemented using a number of heterogeneous processor systems in which a main processor is present with one or more secondary processors on a single chip. As another illustrative example, the processing circuitry may be a symmetric multi-processor system containing multiple processors of the same type. In yet another example, the processing circuitry may be embodied as or otherwise include one or more ASICs, FPGAs or the like. Thus, although the processing circuitry may be capable of executing a computer program to perform one or more functions, the processing circuitry of various examples may be capable of performing one or more functions without the aid of a computer program. In either instance, the processing circuitry may be appropriately programmed to perform functions or operations according to example implementations of the present disclosure.

The memory 1160 is generally any piece of computer hardware that is capable of storing information such as, for example, data, computer programs (e.g., computer-readable program code 1170) and/or other suitable information either on a temporary basis and/or a permanent basis. The memory may include volatile and/or non-volatile memory, and may be fixed or removable. Examples of suitable memory include random access memory (RAM), read-only memory (ROM), a hard drive, a flash memory, a thumb drive, a removable computer diskette, an optical disk, a magnetic tape or some combination of the above. Optical disks may include compact disk-read only memory (CD-ROM), compact disk-read/write (CD-R/W), DVD or the like. In various instances, the memory may be referred to as a computer-readable storage medium. The computer-readable storage medium is a non-transitory device capable of storing information, and is distinguishable from computer-readable transmission media such as electronic transitory signals capable of carrying information from one location to another. Computer-readable medium as described herein may generally refer to a computer-readable storage medium or computer-readable transmission medium.

In addition to the memory 1160, the processing circuitry 1150 may also be connected to one or more interfaces for displaying, transmitting and/or receiving information. The interfaces may include a communications interface 1120. The communications interface 1120 may be configured to transmit and/or receive information, such as to and/or from other apparatus(es), network(s) or the like. The communications interface may be configured to transmit and/or receive information by physical (wired) and/or wireless communications links. Examples of suitable communication interfaces include a network interface controller (NIC), wireless NIC (WNIC) or the like. The communications interface may have one or more transmitters 1130. The communications interface may have one or more receivers 1140.

As indicated above, program code instructions may be stored in memory, and executed by processing circuitry that is thereby programmed, to implement functions of the systems, subsystems, tools and their respective elements described herein. As will be appreciated, any suitable program code instructions may be loaded onto a computer or other programmable apparatus from a computer-readable storage medium to produce a particular machine, such that the particular machine becomes a means for implementing the functions specified herein. These program code instructions may also be stored in a computer-readable storage medium that can direct a computer, a processing circuitry or other programmable apparatus to function in a particular manner to thereby generate a particular machine or particular article of manufacture. The instructions stored in the computer-readable storage medium may produce an article of manufacture, where the article of manufacture becomes a means for implementing functions described herein. The program code instructions may be retrieved from a computer-readable storage medium and loaded into a computer, processing circuitry or other programmable apparatus to configure the computer, processing circuitry or other programmable apparatus to execute operations to be performed on or by the computer, processing circuitry or other programmable apparatus.

Retrieval, loading and execution of the program code instructions may be performed sequentially such that one instruction is retrieved, loaded and executed at a time. In some example implementations, retrieval, loading and/or execution may be performed in parallel such that multiple instructions are retrieved, loaded, and/or executed together. Execution of the program code instructions may produce a computer-implemented process such that the instructions executed by the computer, processing circuitry or other programmable apparatus provide operations for implementing functions described herein.

Execution of instructions by a processing circuitry, or storage of instructions in a computer-readable storage medium, supports combinations of operations for performing the specified functions. In this manner, an apparatus 1100 may include a processing circuitry 1150 and a computer-readable storage medium or memory 1160 coupled to the processing circuitry, where the processing circuitry is configured to execute computer-readable program code 1170 stored in the memory. It will also be understood that one or more functions, and combinations of functions, may be implemented by special purpose hardware-based computer systems and/or processing circuitry s which perform the specified functions, or combinations of special purpose hardware and program code instructions For simplicity and illustrative purposes, the present invention is described by referring mainly to an exemplary embodiment thereof. In the following description, numerous specific details are set forth in order to provide a thorough understanding of the present invention. However, it will be readily apparent to one of ordinary skill in the art that the present invention may be practiced without limitation to these specific details. In this description, well known methods and structures have not been described in detail so as not to unnecessarily obscure the present invention.

Furthermore, the various layers and regions illustrated in the figures are illustrated schematically. Accordingly, embodiments of the present invention are not limited to the relative size, spacing, and alignment illustrated in the accompanying figures. As used herein, a semiconductor layer described as being "on" a substrate or other layer may refer to the layer formed directly on the substrate or other layer, or on an intervening layer or layers formed on the substrate or other layer. As used herein, a semiconductor layer described as being "directly on" another layer means the two layers share an interface—that is, there is no intervening layer between the two. As used herein, references to a structure or feature that is disposed "adjacent" another feature may have portions that overlap or underlie the adjacent feature.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Embodiments of the invention are described herein with reference to cross-section illustrations that are schematic illustrations of idealized embodiments (and intermediate structures) of the invention. The thickness of layers and regions in the drawings may be exaggerated for clarity. Additionally, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a discrete change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. An apparatus, comprising:

a first dielectric layer;

a first conductor forming a first coupling element on the top surface of the first dielectric layer, wherein the first conductor comprises a patch and a first feed line, and wherein the first feed line extends between the patch and an edge of the first dielectric layer;

a second dielectric layer positioned below the first dielectric layer and above a third dielectric layer, wherein the second dielectric layer is vialess; and a second conductor forming a second coupling element, wherein:

the second conductor is on the top surface of the third dielectric layer and extends to an edge of the third dielectric layer, and wherein the second conductor comprises a second feed line that has a smaller width than a width of the first feed line to rovide for impedance matching; and a portion of the first coupling element is directly above a portion of the second coupling element.

2. The apparatus of claim 1, wherein the first feed line is in a non-overlapping arrangement with the second feed line.

3. The apparatus of claim 1, wherein the first conductor further forms a patch antenna on a top surface of the apparatus.

4. The apparatus of claim 1, wherein the first coupling element and the second coupling element transmit and/or receive at a radio frequency (RF).

5. The apparatus of claim 1, further comprising:

a fourth dielectric layer positioned below the second dielectric layer and below the third dielectric layer; and a third conductor forming a ground plane, wherein:

the third conductor is on the bottom surface of the fourth dielectric layer, a portion of the first coupling element is directly above a portion of the ground plane, and a portion of the second coupling element is directly above a portion of the ground plane.

6. The apparatus of claim 1, wherein the first and second coupling elements are parallel across the plane of the apparatus.

7. The apparatus of claim 1, wherein the first and second coupling elements are orthogonal across the plane of the apparatus.

8. The apparatus of claim 1, wherein the first and second conductors extend to different outer edges of the apparatus.

9. The apparatus of claim 1, wherein the second coupling element is a microstrip feed line.

10. A method of forming a vialess transition, the method comprising:

depositing a first dielectric layer;

depositing a first conductor forming a first coupling element on the top surface of the first dielectric layer and forming a first end of the first conductor at an edge of the first dielectric layer;

depositing a second dielectric layer positioned below the first dielectric layer and above a third dielectric layer, wherein the second dielectric layer is vialess; and depositing a second conductor forming a second coupling element and forming an end of the second conductor at an edge of the third dielectric layer, wherein:

the second conductor is on the top surface of the third dielectric layer;

a portion of the first coupling element is directly above a portion of the second coupling element; and the end of the first conductor is in a non-overlapping arrangement with the end of the second conductor;

wherein each of the first and second conductors comprises a trace, and wherein a width of the trace for the first conductor is larger than a width of the trace of the second conductor to provide impedance matching.

11. The method of claim 10, wherein the traces of the first and second conductors are in a non-overlapping arrangement.

12. The method of claim 10, wherein the first conductor further forms a patch antenna.

13. The method of claim 10, wherein the first coupling element is a radio frequency (RF) coupling element.

14. The method of claim 10, further comprising depositing a fourth dielectric layer positioned below the third dielectric layer.

15. The method of claim 14, further comprising:

depositing a third conductor forming a ground plane, wherein:

the third conductor is on the bottom surface of the fourth dielectric layer, a portion of the first coupling element is directly above a portion of the ground plane, and a portion of the second coupling element is directly above a portion of the ground plane.

16. The method of claim 10, wherein the first and second coupling elements are parallel across the plane of the vialess transition.

17. The method of claim 10, wherein the first and second coupling elements are orthogonal across the plane of the vialess transition.

18. The method of claim 10, wherein at least one of the first coupling element and/or the second coupling element is a microstrip feed line.

19. An apparatus, comprising:

an electrically conductive ground plane; and a series of layers mounted on the ground plane, wherein each of the layers comprises a vialess dielectric layer and a conductor on a top surface of the dielectric layer, and wherein each of the conductors comprises a trace that extends inward from an outer edge of the dielectric layer to a central section of the dielectric layer;

wherein a top one of the layers comprises an electrical patch connected to the trace; and wherein a width of the respective traces increases for each of the layers away from the ground plane to allow for impedance matching.

20. The apparatus of claim 19, wherein the traces of different one of the layers extend to different ones of the outer edges.

* * * * *